US009207050B2

(12) United States Patent
Sorensen

(10) Patent No.: US 9,207,050 B2
(45) Date of Patent: Dec. 8, 2015

(54) SHOT SHELL PAYLOADS THAT INCLUDE A PLURALITY OF LARGE PROJECTILES AND SHOT SHELLS INCLUDING THE SAME

(71) Applicant: Michael Clifford Sorensen, Sweet Home, OR (US)

(72) Inventor: Michael Clifford Sorensen, Sweet Home, OR (US)

( * ) Notice: Subject to any disclaimer, the term of this patent is extended or adjusted under 35 U.S.C. 154(b) by 0 days.

(21) Appl. No.: 14/313,700

(22) Filed: Jun. 24, 2014

(65) Prior Publication Data

US 2015/0000545 A1 Jan. 1, 2015

Related U.S. Application Data

(60) Provisional application No. 61/841,075, filed on Jun. 28, 2013.

(51) Int. Cl.

| | |
|---|---|
| ***F42B 12/58*** | (2006.01) |
| ***F42B 7/10*** | (2006.01) |
| ***F42B 7/08*** | (2006.01) |
| ***F42B 5/03*** | (2006.01) |

(52) U.S. Cl.

CPC ... *F42B 7/10* (2013.01); *F42B 5/03* (2013.01); *F42B 7/08* (2013.01)

(58) Field of Classification Search

CPC ..... F42B 5/03; F42B 7/00; F42B 7/02; F42B 7/04; F42B 7/043; F42B 7/046; F42B 7/06; F42B 7/08; F42B 7/10

USPC ..... 102/438, 448, 454, 455, 460

See application file for complete search history.

(56) References Cited

U.S. PATENT DOCUMENTS

| | | | | | |
|---|---|---|---|---|---|
| 1,187,867 | A | | 6/1916 | Shinkle | |
| 1,582,673 | A | | 4/1926 | Fahrenwald | |
| 1,583,559 | A | | 5/1926 | Kenneweg | |
| 2,343,818 | A | * | 3/1944 | Sweeley | 102/454 |
| 3,400,660 | A | | 9/1968 | Malter | |
| 3,906,859 | A | * | 9/1975 | Smith | 102/444 |
| 3,996,865 | A | | 12/1976 | Dwyer | |
| 4,035,116 | A | | 7/1977 | O'Brien et al. | |
| 4,212,244 | A | * | 7/1980 | Flatau | 102/438 |
| 4,655,140 | A | | 4/1987 | Schirneker | |
| 4,714,023 | A | | 12/1987 | Brown | |
| 4,733,611 | A | * | 3/1988 | Janay et al. | 102/439 |
| 4,760,793 | A | | 8/1988 | Herring, III | |
| 4,811,666 | A | | 3/1989 | Lutfy | |
| 4,819,563 | A | | 4/1989 | Bodet | |
| 4,949,644 | A | | 8/1990 | Brown | |
| 5,131,123 | A | | 7/1992 | Brooks | |
| 5,225,628 | A | * | 7/1993 | Heiny | 102/438 |
| 5,395,439 | A | * | 3/1995 | Basin et al. | 106/282 |
| 5,527,376 | A | | 6/1996 | Amick et al. | |
| 5,648,637 | A | * | 7/1997 | Clark, III | 102/438 |
| 5,713,981 | A | | 2/1998 | Amick | |
| 5,747,724 | A | | 5/1998 | Lindgren et al. | |

(Continued)

*Primary Examiner* — Gabriel Klein

(74) *Attorney, Agent, or Firm* — Dascenzo Intellectual Property Law, P.C.

(57) ABSTRACT

Shot shell payloads that include a plurality of large projectiles and shot shells including the same are disclosed herein. The shot shell payloads include a plurality of large projectiles and at least one spacer that is formed from a different material than the large projectiles. A spacer is located between adjacent large projectiles and/or separates adjacent large projectiles. Disclosed shot shell payloads also may include one or more end spacers that are positioned to contact just one large projectile or the plurality of large projectiles in the payload.

22 Claims, 3 Drawing Sheets

(56) References Cited

U.S. PATENT DOCUMENTS

| | | | | |
|---|---|---|---|---|
| 5,811,723 | A | 9/1998 | Stone | |
| 6,070,532 | A | 6/2000 | Halverson | |
| 6,071,359 | A | 6/2000 | Wisniewski et al. | |
| 6,202,561 | B1 | 3/2001 | Head et al. | |
| 6,270,549 | B1 | 8/2001 | Amick | |
| 6,367,388 | B1 | 4/2002 | Billings | |
| 6,415,719 | B1 | 7/2002 | Buccelli et al. | |
| 6,447,715 | B1 | 9/2002 | Amick | |
| 6,749,802 | B2 | 6/2004 | Amick | |
| 6,938,552 | B2 | 9/2005 | Tom et al. | |
| 7,059,233 | B2 | 6/2006 | Amick | |
| 7,210,410 | B1 * | 5/2007 | Widener | 102/502 |
| 7,217,389 | B2 | 5/2007 | Amick | |
| 7,232,473 | B2 | 6/2007 | Elliott | |
| 7,267,794 | B2 | 9/2007 | Amick | |
| 7,361,279 | B2 | 4/2008 | Hernandez et al. | |
| 7,383,776 | B2 | 6/2008 | Amick | |
| 7,640,861 | B2 | 1/2010 | Amick | |
| 7,765,933 | B2 | 8/2010 | Poore et al. | |
| 2005/0066841 | A1 * | 3/2005 | Vasel et al. | 102/502 |
| 2006/0113211 | A1 | 6/2006 | Zethoff et al. | |
| 2010/0175575 | A1 | 7/2010 | Amick | |
| 2010/0294158 | A1 | 11/2010 | Poore et al. | |
| 2011/0203477 | A1 | 8/2011 | Amick | |
| 2013/0008335 | A1 * | 1/2013 | Menefee, III | 102/460 |

* cited by examiner

SHOT SHELL PAYLOADS THAT INCLUDE A PLURALITY OF LARGE PROJECTILES AND SHOT SHELLS INCLUDING THE SAME

RELATED APPLICATION

This application claims priority to U.S. Provisional Patent Application Ser. No. 61/841,075 which was filed on Jun. 28, 2013, the complete disclosure of which is hereby incorporated by reference for all purposes.

FIELD OF THE DISCLOSURE

The present disclosure is directed generally to shot shell payloads that include a plurality of large projectiles and to shot shells that include the disclosed shot shell payloads.

BACKGROUND OF THE DISCLOSURE

Traditionally, shot shells may include a payload that includes a plurality of small shot pellets, or small projectiles. Such a shot shell may be utilized in shotguns to fire upon relatively small targets, or game, at relatively short distances (such as distances of approximately 10-30 meters).

The effective distance of the shot shell and/or the effectiveness of the payload in stopping larger game often may be increased by increasing a size and/or mass of the projectiles. However, this increase in projectile size and/or mass presents unique challenges related to a shot pattern that may be produced thereby. These challenges may be compounded as the number of projectiles decreases to just a few large projectiles. While the increased mass of these projectiles may enable the projectiles to travel farther than smaller projectiles, the significantly fewer projectiles per shell and differences in trajectories/spacing of the projectiles may limit their effectiveness, especially at medium or long distances. Thus, there exists a need for improved shot shell payloads that include a plurality of large projectiles and/or for improved shot shells that include the improved shot shell payloads.

DETAILED DESCRIPTION AND BEST MODE OF THE DISCLOSURE

Figure 1:
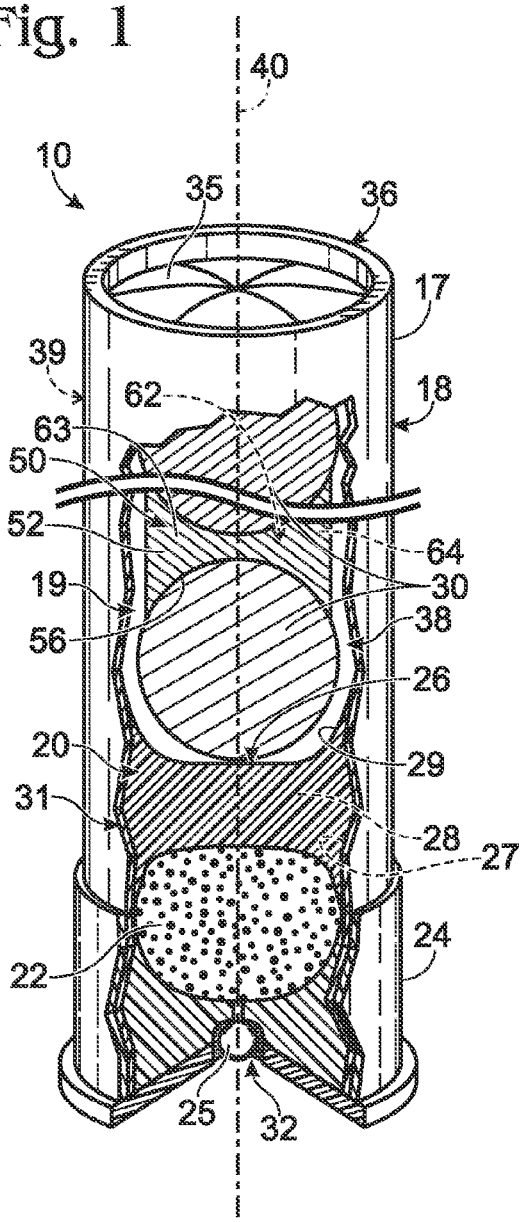
FIG. 1 is a schematic representation of illustrative, non-exclusive examples of a shot shell that may include a payload according to the present disclosure.

FIGS. 1-2 and 4-12 provide illustrative, non-exclusive examples of payloads 38 according to the present disclosure and/or of shot shells 10 that may include and/or utilize payloads 38. Elements that serve a similar, or at least substantially similar, purpose are labeled with like numbers in each of FIGS. 1-2 and 4-12, and these elements may not be discussed in detail herein with reference to each of FIGS. 1-2 and 4-12. Similarly, all elements may not be labeled in each of FIGS. 1-2 and 4-12, but reference numerals associated therewith may be utilized herein for consistency. Elements, components, and/or features that are discussed herein with reference to one or more of FIGS. 1-2 and 4-12 may be included in and/or utilized with any of FIGS. 1-2 and 4-12 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

Figure 2:
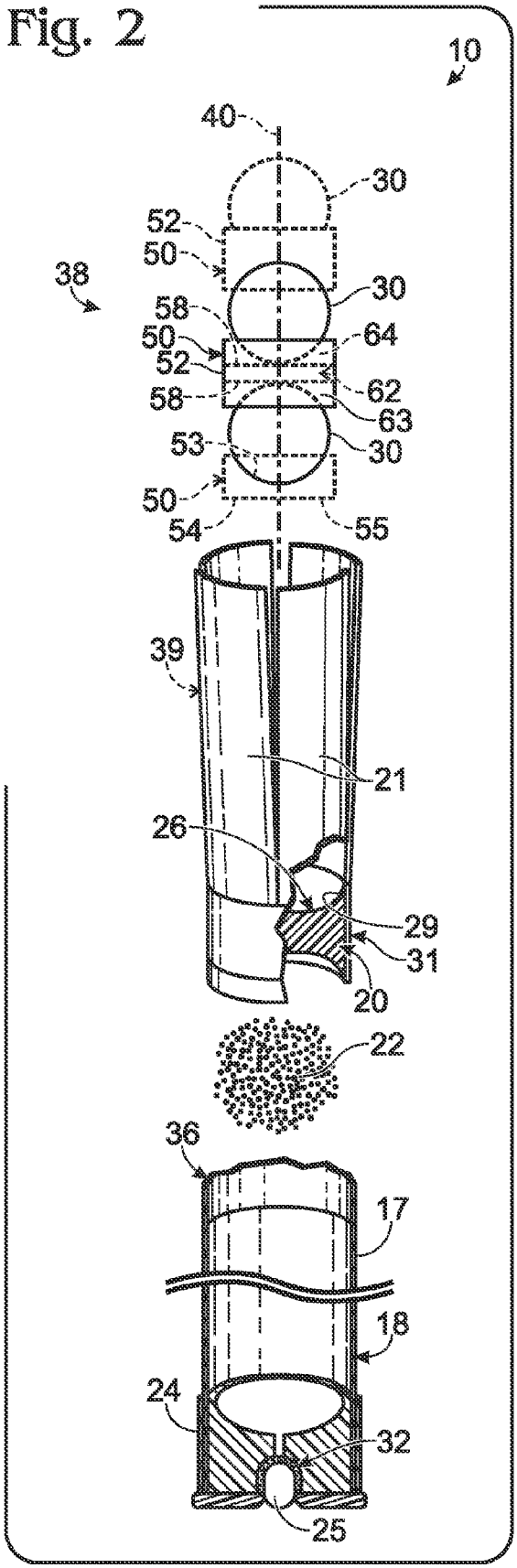
FIG. 2 is an exploded elevation view of the shot shell of FIG. 1.

FIGS. 1-2 provide schematic representations of illustrative, non-exclusive examples of shot shells 10 that may define a payload region 39. Payload region 39 may include a payload 38 according to the present disclosure that includes a plurality of large projectiles 30 and one or more spacers 50 between adjacent large projectiles 30. Shot shell 10 is shown including a head, or head portion, 24, a shot shell case, or casing, 17, and a mouth region 36. Shot shell 10 further includes an ignition device 32, such as primer, or priming mixture, 25, which is located behind a propellant, or powder, 22, which also may be referred to as the charge 22 of the shot shell. Propellant 22 and primer 25 are located behind a partition 31, namely, a wad 20, which serves to segregate the propellant and the primer from the shot shell's payload 38. Powder 22 additionally or alternatively may be referred to as smokeless powder or gun powder. Wad 20 additionally or alternatively may be referred to as a shot wad 20, and it may take a variety of suitable shapes and sizes.

Casing 17 and head 24 additionally or alternatively may be referred to as forming a housing, or hull, 18 of the shot shell. As indicated in FIG. 1, housing 18 (and/or casing 17) may be described as defining an internal chamber, or internal compartment, 19 of the shot shell. When the shot shell is assembled, at least propellant 22, wad 20, and payload 38 are inserted into the internal compartment, such as through mouth region 36. After insertion of these components into the internal compartment, mouth region 36 is sealed or otherwise closed, such as via any suitable closure 35. As an illustrative, non-exclusive example, the region of the casing distal head 24 may be folded, crimped, or otherwise used to close mouth region 36.

Wad 20 typically defines a payload-facing surface 29 that extends and/or faces generally toward mouth region 36 and away from head 24 (when the wad is positioned properly within an assembled shot shell). In the illustrated embodiment, wad 20 includes and/or defines a cup, or cup region, 26, which may have a generally concave configuration and defines a region of the payload-facing surface that is closest to head 24. Between cup 26 and propellant 22, wad 20 also may include a gas seal, or gas seal region, 27 and/or a deformable region 28. Gas seal region 27 is configured to engage the inner surface of the shot gun's chamber and/or barrel to restrict the passage of gasses, which are produced when the shot shell is fired (i.e., when the charge is ignited), along the shot gun's barrel. By doing so, the gasses propel the wad and the payload from the chamber and along and out of the shot gun's barrel. Deformable region 28 may be designed to crumple, collapse, or otherwise non-elastically deform in response to the setback, or firing, forces that are generated when the shot shell is fired and the combustion of the propellant rapidly urges the wad and payload from being stationary to travelling down the barrel of the shot gun at high speeds.

As illustrated in FIG. 2, shot wad 20 may include one or more optional sidewalls 21 that extend from the cup and around the payload region 39 of the wad and/or shot shell. In practice, the sidewalls contain payload 38 within the assembled shot shell. When the shot shell is fired, the sidewalls are intended to protect the inner surface of the shot gun's barrel from being contacted, and thus potentially damaged, by the payload as the wad and the payload travel down the barrel. In the illustrated example, the wad includes a plurality of sidewall sections that are joined together proximate the cup region of the wad and which are not secured together proximate the forward/mouth region of the cup. Although this is not required, such a configuration permits the sidewall regions to flare away from each other when the wad exits the shot gun's barrel after the shot shell is fired, with this flaring increasing the wind resistance of the wad and slowing the wad, thereby separating it from the payload and reducing the distance that it travels from the shot gun.

Shot shell 10 and its components have been schematically illustrated in FIGS. 1 and 2 and are not intended to require a specific shape, size, or quantity of the components thereof. The length and diameter of the overall shot shell 10 and its casing 17, the amount of primer 25 and propellant 22, the shape, size, and configuration of wad 20, the type, shape, size, and/or number of projectiles 30, etc. all may vary within the scope of the present disclosure. For the purpose of simplifying the present discussion, references have been and will continue to be made to shot guns as the firearms in which shot shells are used, but shot shells according to the present disclosure may be used with any firearm that is sized and/or otherwise configured to receive and fire a shot shell.

It is within the scope of the present disclosure that shot shell 10 may define configurations and/or may include components other than those that are illustrated in FIG. 2. Illustrative, non-exclusive examples of payloads, payload compositions, payload materials of construction, methods of manufacturing payloads, shot shell components, and/or shot shell configurations are disclosed in U.S. Pat. Nos. 1,583,559, 3,996,865, 4,760,793, 5,527,376, 5,713,981, 6,202,561, 6,270,549, 6,367,388, 6,415,719, 6,447,715, 6,749,802, 7,059,233, 7,217,389, 7,232,473, 7,267,794, 7,383,776, 7,640,861, and 7,765,933, and in U.S. Patent Application Publication Nos. 2006/0118211, 2010/0175575, 2011/0203477, and 2010/0294158, the complete disclosures of which are hereby incorporated by reference.

As illustrated in FIGS. 1-2 and discussed herein, payloads 38 according to the present disclosure include at least two large projectiles 30 and at least one spacer 50 that is located between adjacent large projectiles 30. In other words, spacer 50 is positioned between, and/or otherwise separates a pair of large projectiles 30 which, as discussed, may be aligned along the longitudinal axis of the wad, the payload, and/or the shot shell. As also discussed herein, spacer 50 may engage each of the pair of large projectiles when the projectiles and spacer are operatively assembled within the wad, and the spacer is formed from a different material and/or composition than the large projectiles.

It is within the scope of the present disclosure that payloads 38 may include two large projectiles 30 or more than two large projectiles 30, such as three (or at least three), four (or at least four), or five (or at least five), large projectiles 30. Additionally or alternatively, payloads 38 also may include fewer than six, fewer than five, fewer than four, or fewer than three large projectiles 30.

Similarly, payloads 38 according to the present disclosure also may include any suitable number of spacers 50. As illustrative, non-exclusive examples, payloads 38 may include one (or at least one), two (or at least two), three (or at least three), four (or at least four), five (or at least five), or six (or at least six) spacers 50. Additionally or alternatively, payloads 38 also may include fewer than six, fewer than five, fewer than four, fewer than three, or fewer than two spacers 50.

It is within the scope of the present disclosure that the number of spacers 50 within payload 38 may be selected based, at least in part, on the number of large projectiles 30 within the payload. As an illustrative, non-exclusive example, and as illustrated in FIGS. 1-2, projectiles 30 may be arranged along a longitudinal axis 40 of shot shell 10 (and/or payload 38 thereof) and spacers 50, which also may be referred to herein as double-sided spacers 52, may be located between adjacent pairs of large projectiles 30. Thus, the number of spacers within payload 38 may be one less than the number of large projectiles within payload 38. As another illustrative, non-exclusive example, and as illustrated in FIG. 2, payload 38 further may include one or more single-sided spacers 54 (which additionally or alternatively may be referred to herein as end spacers 54), which may not be located between adjacent pairs of large projectiles 30. For example, a single-sided spacer 54 may contact a large projectile 30 on a projectile-facing surface 53, but not on an opposing surface 55. Opposing surface 55 may be, for example, positioned adjacent payload-facing surface 29 of wad 20, adjacent mouth region 36 of casing 17 once placed inside the casing, and/or on an opposite surface of the single-sided spacer than the projectile-facing surface. Thus, the number of spacers within payload 38 may be equal to, or even one greater than, the number of large projectiles within the payload.

As used herein, double-sided and single-sided refer to the number of large projectiles 30 that a spacer 50 contacts and/or is immediately adjacent. Accordingly, a double-sided spacer refers to a spacer that includes generally opposed surfaces that respectively face and/or engage a pair of spaced-apart large projectiles. Similarly, a single-sided spacer refers to a spacer that includes a first surface that faces and/or engages a surface of a large projectile and a second, generally opposed, surface that does not face and/or engage a surface of a large projectile. In such an embodiment, such an opposed surface may face and/or engage the cup, face away from the cup, face and/or engage closure 35, face away from closure 35, and/or face and/or engage another spacer 50.

As discussed herein, the use of large projectiles 30 within shot shell 10 may extend the effective range (or distance) of the shot shell and/or may permit the shot shell to be utilized with larger game (due to the increased impact force of the projectile). Illustrative, non-exclusive examples of such larger game include larger varmints, feral pigs, etc. However, the wide shot pattern and/or pattern density that may be produced by these large projectiles, coupled with the small number of large projectiles that may be located within a given shot shell 10 due to size and/or space constraints, may preclude their effective use at distances of greater than a few yards. For example, a general rule of thumb is that double-ought (00) buck shot, which has a diameter of 0.33 inches (0.84 cm) will spread/disperse/diverge at a rate of approximately one inch (2.54 cm) per yard (0.914 meters). Therefore, at a range of 40 yards (36.58 m), the pellets will define a shot pattern that is approximately 40 inches (0.102 m) wide. Furthermore, projectiles that are larger than double-ought shot may have a dispersal rate that is greater than double-ought shot. Consider further that when only a few larger projectiles are utilized, the likelihood of a projectile hitting, much less lethally hitting, game that is 30, 40, or 50 yards away is low.

Figure 3:
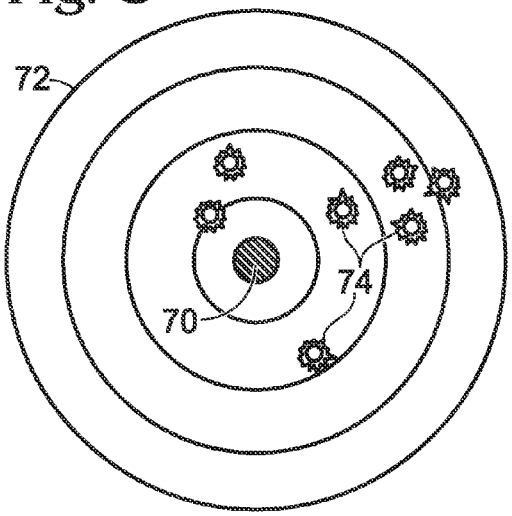
FIG. 3 is an image of a target that has been fired upon by three shot shells that include payloads according to the present disclosure.

With this in mind, shot shells 10 that include spacers 50 and/or payloads 38 according to the present disclosure are configured to have an increased effective range and/or an improved pattern density when compared to shot shells that do not include spacers 50 and/or payloads 38 according to the present disclosure. This is illustrated in FIG. 3. In this example, three shot shells that include a payload according to the present disclosure were fired at a target 70 from a distance of 50 yards. Each of the shot shells included three large projectiles (for a total of nine large projectiles fired). Impact holes 74 for seven of the nine large projectiles were grouped within an 18" diameter circle 72, as shown in FIG. 3, and all nine of the large projectiles impacted a 30" diameter circle. In contrast, and using the same large projectiles but without spacers located therebetween, it was not possible to reliably (repeatedly) impact a 48" square target at a distance of 40 yards.

With this in mind, payloads 38 according to the present disclosure include both large projectiles 38 and at least one spacer 50, with spacer 50 serving to tighten, narrow, and/or otherwise improve the pattern density of projectiles 30. Thus, payloads 38 according to the present disclosure may permit effective use of shot shells 10 according to the present disclosure over a broader range of distances and/or at greater maximum distances.

Returning to FIGS. 1-2, large projectiles 30 and spacers 50 may be placed and/or located within contact, physical contact, and/or mechanical contact with each other within shot shell 10 and/or payload 38 thereof. It is within the scope of the present disclosure that large projectiles 30 and spacers 50 may not be operatively attached and/or adhered to one another and/or may be free to separate from one another subsequent to being fired from the shotgun.

However, it is also within the scope of the present disclosure that one or more spacers 50 may be operatively attached, such as through the use of an adhesive, to one or more large projectiles 30 within payload 38. As an illustrative, non-exclusive example, and when a given large projectile 30 includes an associated spacer 50 that is in contact with the large projectile and located between the given large projectile and propellant 22, the spacer optionally may be operatively attached to the large projectile. This may include operatively attaching each spacer 50 that is present within payload 38 to a respective large projectile 30 and/or operatively attaching a selected (or the only) spacer to a specific one of the plurality of large projectiles. Such an arrangement further may change, modify, and/or improve the pattern density of shot shell 10. For example, and although not required to all embodiments, adhesively securing the spacer to a portion of a large projectile that generally faces the cup of the assembled shot shell (i.e., generally faces away from the mouth region of the shot shell) may enable the spacer to provide a fletching effect that improves the stability and/or trajectory of the large projectile when the shot shell is fired. As used herein, the surface, or region, of a large projectile that generally faces the cup of the wad when assembled in a shot shell may be referred to as the cup-facing surface or region of the large projectile, and the surface, or region, of a large projectile that generally faces away from the cup of the wad when assembled in a shot shell may be referred to as the mouth-facing and/or leading surface or region of the large projectile.

Large projectiles 30, which also may be referred to herein as projectiles 30, may have and/or define any suitable shape. As an illustrative, non-exclusive example, projectiles 30 may define a spherical, or at least substantially spherical, shape. As additional illustrative, non-exclusive examples, projectiles 30 may include and/or define a cylindrical shape, a hemispherical shape, a conical shape, a pointed shape, a blunt shape, an ogived shape, a mushroom shape, a shape that is symmetrical, or at least substantially symmetrical, about an axis of rotation, and/or any other suitable three-dimensional shape.

Projectiles 30 further may define any suitable volume, size, diameter, characteristic diameter, and/or characteristic dimension. As illustrative, non-exclusive examples, and when projectiles 30 define a spherical, or at least substantially spherical, shape, the diameter (and/or characteristic diameter and/or characteristic dimension) of projectiles 30 may be at least 8 mm, at least 9 mm, at least 10 mm, at least 12 mm, at least 14 mm, at least 16 mm, or at least 18 mm. Additionally or alternatively, the diameter of projectiles 30 may be less than 20 mm, less than 18 mm, less than 16 mm, less than 14 mm, or less than 12 mm. References herein to "large" projectiles refer to the dimension of the projectile relative to the transverse direction of the longitudinal axis of the wad and/or corresponding shot shell containing the wad and large projectile. As discussed and illustrated herein, the large projectiles may have a cross-sectional area measured in this transverse direction that is at least 70%, at least 75%, at least 80%, at least 85%, at least 90%, at least 95%, at least 98%, and/or at least 100% of this cross-sectional area measured in this transverse direction (as defined by the inner/interior perimeter surface of the wad and/or housing of the shell).

Shot shells 10 may be sized and/or designed for use in a given and/or specified size, or gauge, of shotgun. As such, the diameter (and/or characteristic diameter and/or characteristic dimension) of projectiles 30 may be selected based, at least in part, on a size, diameter, and/or gauge of the shotgun (or barrel thereof) within which the shot shells are designed to be used and/or from which the shot shells are designed and/or sized to be fired. As illustrative, non-exclusive examples, the diameter of projectiles 30 may be at least 50%, at least 55%, at last 60%, at least 65%, at least 70%, at least 75%, at least 80%, or at least 85% of the diameter of the shotgun barrel from which they are designed to be fired. As additional illustrative, non-exclusive examples, the diameter of projectiles 30 may be less than 99%, less than 97.5%, less than 95%, less than 92.5%, less than 90%, less than 87.5%, less than 85%, less than 82.5%, or less than 80% of the diameter of the shotgun barrel from which they are designed and/or sized to be fired.

It is within the scope of the present disclosure that projectiles 30 may be formed from any suitable material or combination of materials. As illustrative, non-exclusive examples, projectiles 30 may include, be formed from, comprise, consist of, and/or consist essentially of any suitable type and/or number of metal and/or non-metal components. In some embodiments, large projectile 30 is formed substantially, or even exclusively, from a metallic component, or optionally a plurality of metallic components. In some embodiments, large projectile 30 is formed from a combination of metallic and non-metallic components. Illustrative, non-exclusive examples of suitable metallic components for large projectile 30 include iron, steel, tungsten, bronze, copper, brass, nickel, cobalt, chromium, bismuth, zinc, lead, and mixtures and/or alloys thereof. Illustrative, non-exclusive examples of non-metallic components include waxes, lubricants, resins (including thermoplastic and/or thermoset resins), and non-metallic binders. When present, non-metallic components typically will form a minority (less than 50 wt %, less than 25 wt %, less than 15 wt %, less than 10 wt %, less than 5 wt %, or less than 3 wt %) of the large projectile. Additional illustrative, non-exclusive examples of materials that may be included within projectiles 30 are disclosed in the patent documents that are incorporated by reference herein.

Large projectiles 30 may be frangible or non-frangible. Similarly, large projectiles may be formed from non-toxic materials and/or may be lead-free, although it also is within the scope of the present disclosure that large projectile 30 may contain and/or be formed from lead. Large projectile 30 may be formed by any suitable process, including powder metallurgy, machining, and/or casting processes, and large projectile 30 may include an optional coating or core having a different composition than the rest of the large projectile.

Additionally or alternatively, it is also within the scope of the present disclosure that projectiles 30 also may define any suitable weight, or mass. As illustrative, non-exclusive examples, the mass of each projectile 30 that is contained within shot shell 10 may be at least 4 grams, at least 5 grams, at least 6 grams, at least 7 grams, at least 8 grams, at least 10 grams, at least 12 grams, at least 14 grams, at least 16 grams, at least 18 grams, or at least 20 grams. Additionally or alternatively, the mass of each projectile 30 also may be less than 30 grams, less than 28 grams, less than 26 grams, less than 24 grams, less than 22 grams, less than 20 grams, less than 18 grams, less than 16 grams, less than 14 grams, less than 12 grams, or less than 10 grams.

Spacer 50 may include and/or define any suitable structure, shape, contour, and/or conformation that may physically, mechanically, spatially, resiliently, elastomerically, pliantly, and/or compliantly separate a given projectile 30 from an adjacent projectile 30 within shot shell 10 and/or payload 38 thereof. This may include separating adjacent projectiles 30 prior to shot shell 10 being discharged and/or fired from the shotgun. Additionally or alternatively, this also may include separating adjacent projectiles 30 during firing of the shot shell and/or absorbing at least a portion of a setback force that is generated during discharge of shot shell 10. Thus, spacers 50 additionally or alternatively may be referred to herein as shock-absorbing spacers 50 and/or as shock-absorbers 50, and this absorption of setback forces may decrease a potential for projectiles 30 to follow divergent paths, or trajectories, (or decrease a divergence of the paths) subsequent to discharge of shot shell 10 by the shotgun.

It is within the scope of the present disclosure that spacer 50 may separate adjacent projectiles 30 in any suitable manner. As an illustrative, non-exclusive example, and as illustrated in FIGS. 1-2, spacer 50 may extend between, or entirely between, adjacent projectiles 30. As another illustrative, non-exclusive example, and as illustrated in FIG. 1, spacer 50 may define one or more concave surfaces 56, with these concave surfaces being sized and/or shaped to receive and/or contact at least a portion of projectiles 30. This may include receiving, supporting, and/or contacting a given projectile 30 over at least 5%, at least 10%, at least 15%, at least 20%, at least 25%, at least 30%, at least 35%, or at least 40% of a surface area of the given projectile. Additionally or alternatively, this also may include receiving, supporting, and/or contacting the given projectile over less than 50%, less than 45%, less than 40%, less than 35%, less than 30%, less than 25%, or less than 20% of the surface area of the given projectile.

As yet another illustrative, non-exclusive example, and as illustrated in dashed lines in FIG. 2, spacer 50 may define one or more flat surfaces 58 that may be configured to contact projectiles 30. As illustrated, each of the flat surfaces extends generally transverse to a longitudinal axis that extends through the centers of the large projectiles, such as which will align with the longitudinal axis of the wad and/or shot shell containing the large projectiles and spacer. As another illustrative, non-exclusive example, spacer 50 may include and/or be a hollow cylinder that receives, contacts, and/or supports a given projectile 30 in a circular and/or annular contact region that is defined between the spacer and the projectile.

Figure 7:
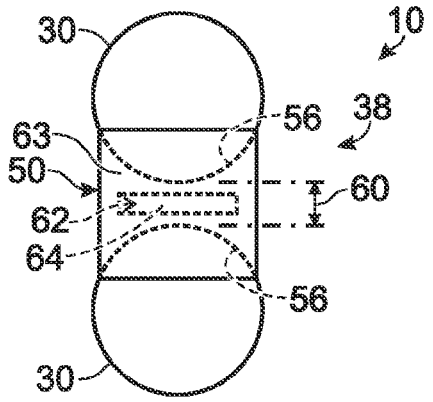
FIG. 7 is a schematic cross-sectional view of illustrative, non-exclusive examples of a portion of a payload according to the present disclosure.

Spacers 50 may be sized, selected, and/or configured to maintain at least a threshold separation distance (as illustrated in FIG. 7 at 60) between adjacent projectiles 30 while projectiles 30 are located within payload 38. As illustrative, non-exclusive examples, spacers 50 may be configured to maintain a threshold separation distance of at least 0.5 mm, at least 0.75 mm, at least 1 mm, at least 1.25 mm, at least 1.5 mm, at least 1.75 mm, at least 2 mm, at least 2.25 mm, or at least 2.5 mm between adjacent projectiles 30. Additionally or alternatively, spacers 50 also may be configured to maintain a threshold separation distance of less than 5 mm, less than 4.5 mm, less than 4 mm, less than 2.5 mm, less than 2.25 mm, less than 2 mm, less than 1.75 mm, less than 1.5 mm, or less than 1 mm between adjacent projectiles 30.

Spacer 50 is formed from a different material and/or has a different composition than the large projectiles, and spacer 50 typically will be less dense, more resilient, more elastic, more compliant, and/or less hard than the large projectile. In many embodiments, spacer 50 will be non-metallic and/or be at least substantially or even completely formed from non-metallic materials. Spacer 50 may be formed from and/or defined by any suitable material 63, which also may be referred to herein as a first spacer material 63. As illustrative, non-exclusive examples, spacer 50 may be formed from and/or include a resilient material, an elastomeric material, a compliant material, and/or a pliant material. As more specific but still illustrative, non-exclusive examples, spacer 50 may be formed from and/or include a polymeric material, a polyethylene, a low density polyethylene, a high density polyethylene, a polystyrene, a polypropylene, a silicone, a polyvinyl chloride, a polyamide, a natural and/or synthetic rubber, a cork, a polytetrafluoroethlene, a polyester, an organic polymer, and/or an inorganic polymer.

Spacer 50 may include and/or be a single-piece, solid, and/or monolithic structure and/or may fill an entirety of a volume that is defined by an outer surface thereof. However, spacer 50 optionally also may include and/or be a hollow, porous, and/or void-filled structure that defines at least a portion of one or more voids, openings, and/or internal volumes 62. When spacer 50 defines internal volume 62, it is within the scope of the present disclosure that the internal volume may include and/or contain any suitable material 64, which also may be referred to herein as a second spacer material 64. Illustrative, non-exclusive examples of second material 64 include a fluid, a gas, air, a particulate material, a polymeric material, a resilient material, and/or a material with a different composition than a composition of first material 63 (though it is within the scope of the present disclosure that second material 64 may include and/or be any of the materials that are disclosed herein with reference to first material 63).

Figure 5:
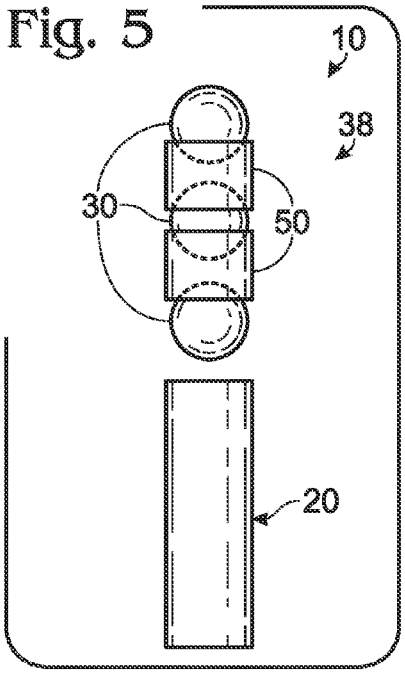
FIG. 5 is an image of an illustrative, non-exclusive example of an assembled payload according to the present disclosure.
Figure 4:
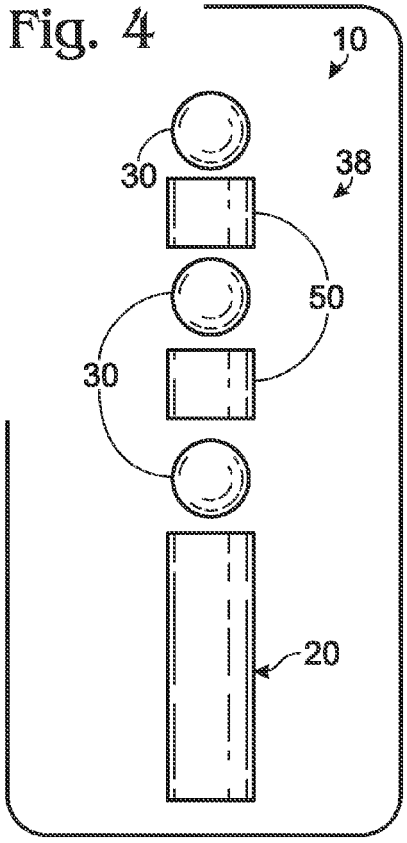
FIG. 4 is an image of an illustrative, non-exclusive example of a disassembled payload according to the present disclosure.
Figure 6:
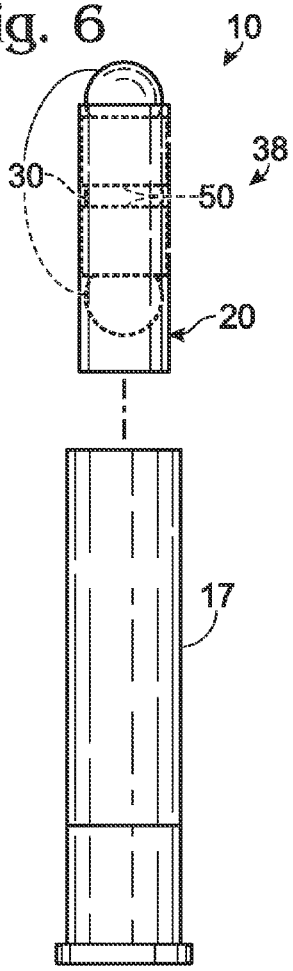
FIG. 6 is an image of the assembled payload of FIG. 5 within a wad, and partially inserted into a shot shell that may contain the payload and wad.

More specific (but still illustrative, non-exclusive) examples of configurations of projectiles 30 and/or spacers 50 within shot shells 10 and/or payloads 38 thereof are illustrated in FIGS. 4-12. FIGS. 4-6 are images of a payload 38 according to the present disclosure and/or of a shot shell 10 and/or components thereof that may include payload 38 according to the present disclosure. FIGS. 7-12 provide schematic cross-sectional views of illustrative, non-exclusive examples of portions of payloads 38 and/or components thereof according to the present disclosure.

Payload 38 of FIGS. 4-6 includes three projectiles 30 and two spacers 50, though, as discussed herein, greater and/or fewer numbers of projectiles 30 and/or spacers 50 are also within the scope of the present disclosure. FIG. 4 provides an exploded view of payload 38, including projectiles 30 and spacers 50 thereof, disassembled from but next to a wad 20. In FIG. 5, payload 38 is assembled but has not been placed within wad 20. In FIG. 6, payload 38 has been assembled and, as shown, at least a portion of payload 38 may be placed and/or located within wad 20. The payload 38 and wad 20 may be inserted within a shot shell casing 17 to form a completed, or assembled, shot shell 10 that may include a payload 38 according to the present disclosure.

FIGS. 7-12 provide additional illustrative, non-exclusive examples of payloads 38 with at least two large projectiles 30 and at least one spacer 50 according to the present disclosure. Large projectiles 30 are illustrated as having spherical shapes, but it is within the scope of the present disclosure that the large projectiles 30 that are schematically illustrated in FIGS. 7-12 may have any of the shapes, sizes, compositions, etc. that are described, illustrated, and/or incorporated herein. Similarly, to further simplify FIGS. 7-12, payload 38 is illustrated with two projectiles 30 and one spacer 50, though greater numbers of projectiles 30 and/or spacers 50 are also within the scope of the present disclosure, as disclosed and/or illustrated herein. For example, it is within the scope of the present disclosure that any of the payloads of FIGS. 7-12 may include at least one or more additional large projectiles 30 (axially aligned with the illustrated two large projectiles) and at least one or more additional spacers 50 that maintain the plurality of large projectiles spaced apart from each other. Additionally or alternatively, one or more additional spacers 50 or end spacers 54 may be positioned to maintain one or more respective large projectiles spaced apart from the payload-facing surface of the wad or the closure of the shot shell. Furthermore, the inclusion of reference numeral 10 in FIGS. 7-12 graphically represents a shot shell 10 containing the illustrated payload.

In FIG. 7, spacer 50 includes two concave surfaces 56 that are configured to receive, support, and/or contact respective projectiles 30. As discussed in more detail herein, this may include supporting the projectiles over at least a portion of a surface area thereof. FIG. 7 also illustrates that spacer 50 maintains threshold separation distance 60 between projectiles 30, with illustrative, non-exclusive examples of the threshold separation distance being discussed in more detail herein. As illustrated in solid lines in FIG. 7, spacer 50 may be formed from, formed entirely from, and/or formed solely from a first material 63.

As illustrated in dashed lines in FIG. 7 and discussed herein, spacer 50 optionally may define an internal volume 62. When present, internal volume 62 also may include, contain, and/or house a second spacer material 64 that is different from first spacer material 63. Illustrative, non-exclusive examples of first spacer material 63 and second spacer material 64 are disclosed herein.

Figure 8:
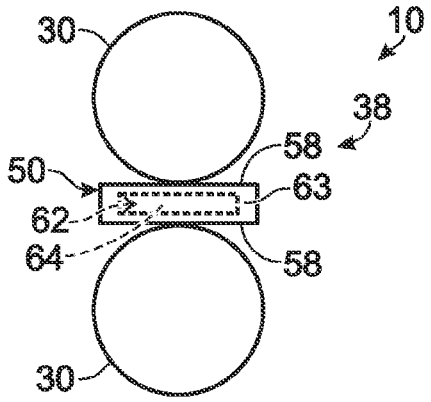
FIG. 8 is another schematic cross-sectional view of illustrative, non-exclusive examples of a portion of a payload according to the present disclosure.

In FIG. 8, spacer 50 includes two flat, or at least substantially flat, surfaces 58 that support and/or contact respective projectiles 30. At least a portion of spacer 50 of FIG. 8 is formed from first material 63. In addition, and as illustrated in dashed lines in FIG. 8, spacer 50 optionally may define internal volume 62, which optionally may contain any suitable second material 64.

Figure 9:
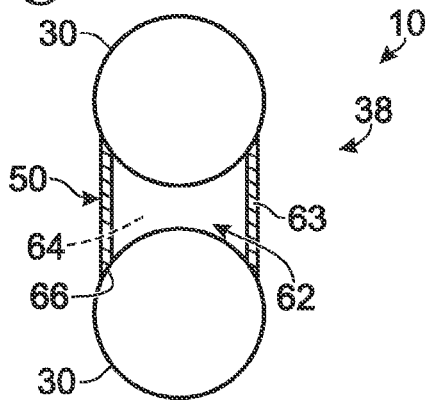
FIG. 9 is another schematic cross-sectional view of illustrative, non-exclusive examples of a portion of a payload according to the present disclosure.

In FIG. 9, spacer 50 is defined by a cylinder (or cylindrical body) that may define an internal volume 62 and that contacts projectiles 30 in a contact region 66 thereof. Contact region 66 may include and/or define any suitable contact shape. As an illustrative, non-exclusive example, and as illustrated in FIG. 9, a shape of contact region 66 may be at least partially conformed to a shape of projectiles 30. As such, contact region 66 may define a broad, thick, and/or annular contact region that is present, or defined, across a majority and/or all of a thickness of a wall of the spacer. Additionally or alternatively, it is within the scope of the present disclosure that contact region 66 may not be conformed to the shape of projectiles 30 (such as when the ends of spacer 50 are simply cut at right angles with respect to the walls of spacer 50). As such, contact region 66 also may be thinner than the thickness of the spacer and/or may define a circular contact region and/or a line (or quasi-line) contact region. Similar to FIGS. 7-8, at least a portion of spacer 50 of FIG. 9 is formed from first material 63. In addition, and as illustrated in dashed lines in FIG. 9, internal volume 62 further may include and/or contain any suitable second material 64.

Figure 10:
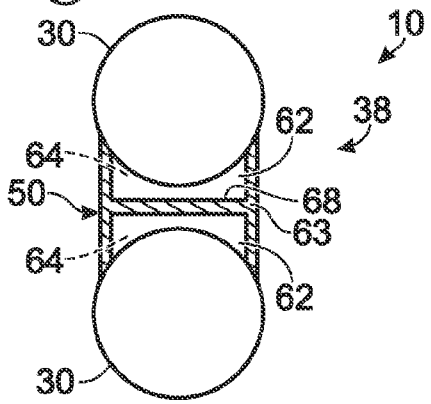
FIG. 10 is another schematic cross-sectional view of illustrative, non-exclusive examples of a portion of a payload according to the present disclosure.

Spacer 50 of FIG. 10 is substantially similar to spacer 50 of FIG. 9; however, the spacer of FIG. 10 further includes a partition 68 and defines two separate internal volumes 62. Once again, spacer 50 includes at least first material 63. In addition, and as illustrated in dashed lines in FIG. 10, one or more internal volumes 62 also may include any suitable second material 64.

Figure 11:
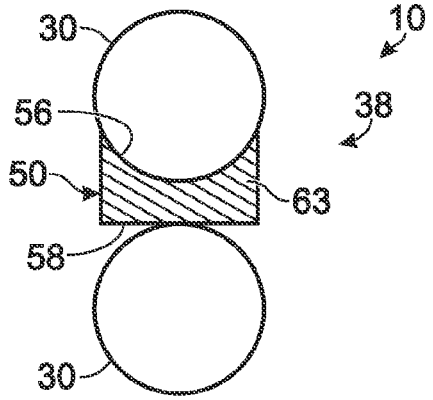
FIG. 11 is another schematic cross-sectional view of an illustrative, non-exclusive example of a portion of a payload according to the present disclosure.

FIG. 11 illustrates that spacer 50 need not be symmetrical with respect to projectiles 30 and/or that spacer 50 may contact a first projectile 30 differently than a second projectile 30. Thus, the spacer of FIG. 11 also may be referred to herein as an asymmetrical spacer 50. In the illustrative, non-exclusive example of FIG. 11, spacer 50 defines both a concave surface 56 and a flat surface 58, with each of these surfaces contacting respective projectiles 30. In other examples, asymmetrical spacer 50 may be positioned as an end spacer, where one surface (e.g., concave surface 56) contacts a large projectile 30, but the opposite surface (e.g., flat surface 58) does not.

FIG. 11 illustrates spacer 50 as including only first material 63; however, it is within the scope of the present disclosure that spacer 50 of FIG. 11 also may include internal volume 62 and/or second material 64, as illustrated in FIGS. 7-10 and discussed herein. In addition, and while FIG. 11 illustrates asymmetrical spacer 50 as including concave surface 56 and flat surface 58, it is within the scope of the present disclosure that the asymmetrical spacer may define any suitable asymmetrical shape that may include any of the structures and/or shapes that are disclosed herein.

Figure 12:
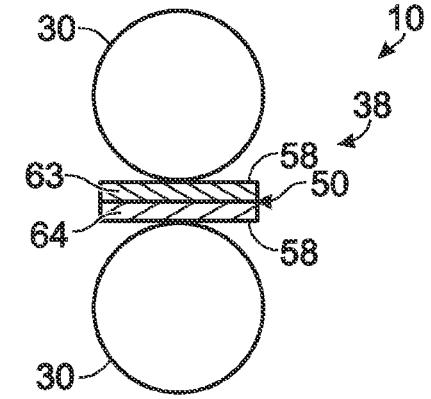
FIG. 12 is another schematic cross-sectional view of an illustrative, non-exclusive example of a portion of a payload according to the present disclosure.

FIG. 12 illustrates spacer 50 in which first material 63 defines a first flat surface 58 that contacts a first projectile 30, while second material 64 defines a second flat surface 58 that contacts a second projectile 30. While FIG. 12 illustrates only two different materials and/or two layers within spacer 50, it is within the scope of the present disclosure that spacer 50 may include a plurality of layers and/or a plurality of materials of construction, including at least three, at least four, at least five, or more than five layers and/or materials of construction. Similar to the asymmetrical spacer of FIG. 11, it is within the scope of the present disclosure that the layers of FIG. 12 may be incorporated into any of the illustrative, non-exclusive examples of spacers that are disclosed herein and/or that spacer 50 of FIG. 12 may include any suitable surface and/or surface shape that may contact projectiles 30.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Illustrative, non-exclusive examples of inventive subject matter according to the present disclosure are described in the following enumerated paragraphs:

A1. A shot shell payload, comprising:

a plurality of projectiles, the plurality of projectiles comprising at least a first projectile and a second projectile aligned with the first projectile along a longitudinal axis of the shot shell payload; and a spacer aligned with the first projectile and the second projectile along the longitudinal axis of the shot shell payload, the spacer being configured to separate the first projectile from the second projectile by a threshold separation distance.

A2. The shot shell payload of paragraph A1, wherein the plurality of projectiles further comprises a third projectile aligned with the first projectile and the second projectile along the longitudinal axis of the shot shell payload, a fourth projectile aligned with the first projectile, the second projectile, and the third projectile along the longitudinal axis of the shot shell payload, and/or a fifth projectile aligned with the first projectile, the second projectile, the third projectile, and the fourth projectile along the longitudinal axis of the shot shell payload.

A3. The shot shell payload of any of paragraphs A1-A2, wherein at least one of the plurality of projectiles is a large projectile.

A4. The shot shell payload of any of paragraphs A1-A3, wherein at least one of the plurality of projectiles comprises a metallic material, a nonmetallic material, and/or a combination of a metallic material and a nonmetallic material.

A5. The shot shell payload of any of paragraphs A1-A4, wherein at least one of the plurality of projectiles comprises iron steel, tungsten, bronze, copper, brass, nickel, cobalt, chromium, bismuth, zinc, lead, and/or alloys or combinations of the above.

A6. The shot shell payload of any of paragraphs A1-A5, wherein at least one of the plurality of projectiles comprises a wax, a lubricant, a resin, a nonmetallic binder, a polymeric material, and/or a combination of the above.

A7. The shot shell payload of any of paragraphs A1-A6, wherein at least one of the plurality of projectiles comprises a spherical, cylindrical, hemispherical, conical, pointed, blunt, ogived, mushroom-shaped, and/or symmetrical projectile.

A8. The shot shell payload of any of paragraphs A1-A7, wherein the spacer is positioned between the first projectile and the second projectile.

A9. The shot shell payload of any of paragraphs A1-A8, wherein the spacer comprises a first concave surface configured to receive at least a portion of one of the plurality of projectiles.

A10. The shot shell payload of any of paragraphs A1-A9, wherein the spacer comprises a second concave surface configured to receive at least a portion of one of the plurality of projectiles.

A11. The shot shell payload of any of paragraphs A1-A9, wherein the spacer comprises a first flat surface.

A12. The shot shell payload of paragraph A11, wherein the first flat surface is configured to contact one of the plurality of projectiles.

A13. The shot shell payload of any of paragraphs A1-A12, wherein the spacer comprises a second flat surface.

A14. The shot shell payload of paragraph A13, wherein the second flat surface is configured to contact one of the plurality of projectiles.

A15. The shot shell payload of any of paragraphs A1-A14, wherein the spacer comprises a first material and a second material, the second material being different from the first material.

A16. The shot shell payload of paragraph A15, wherein the first material of the spacer contacts one of the plurality of projectiles and the second material of the spacer contacts another of the plurality of projectiles.

A17. The shot shell payload of paragraph A16, wherein the spacer comprises a first flat surface and a second flat surface, and wherein the first flat surface comprises the first material and the second flat surface comprises the second material.

A18. The shot shell payload of any of paragraphs A1-A17, wherein the spacer comprises a cylindrical body that defines an internal volume.

A19. The shot shell payload of paragraph A18, wherein the spacer further comprises a contact region that conforms to one or more of the plurality of projectiles.

A20. The shot shell payload of any of paragraphs A1-A19, wherein the spacer comprises a partition separating a first internal volume from a second internal volume.

A21. The shot shell payload of any of paragraphs A1-A20, wherein the spacer comprises a resilient, elastomeric, and/or compliant material.

A22. The shot shell payload of any of paragraphs A1-A21, wherein the spacer comprises a polyethylene, a low density polyethylene, a high density polyethylene, a polystyrene, a polypropylene, a silicone, a polyvinyl chloride, a polyamide, a natural and/or synthetic rubber, a polytetrafluoroethlene, a polyester, an organic polymer, and/or an inorganic polymer.

A23. The shot shell payload of any of paragraphs A1-A22, wherein the spacer comprises a monolithic spacer.

A24. The shot shell payload of any of paragraphs A1-A23, wherein the spacer comprises a hollow, porous, and/or void-filled structure defining one or more internal volumes.

A25. The shot shell payload of paragraph A18, wherein the internal volume comprises a fluid, a gas, a particulate material, a polymeric material, a resilient material, and/or combinations of the above.

A26. The shot shell payload of paragraph A20, wherein the first internal volume and/or the second internal volume comprises a fluid, a gas, a particulate material, a polymeric material, a resilient material, and/or combinations of the above.

A27. The shot shell payload of paragraph A24, wherein the one or more internal volumes comprise a fluid, a gas, a particulate material, a polymeric material, a resilient material, and/or combinations of the above.

A28. The shot shell payload of any of paragraphs A1-A27, wherein the spacer comprises a spacer material, each of the plurality of projectiles comprises a projectile material, and the spacer material is different from the projectile material.

A29. The shot shell payload of any of paragraphs A1-A28, wherein the spacer is configured to tighten, narrow, and/or otherwise improve a pattern density of the plurality of projectiles as they are fired.

A30. The shot shell payload of any of paragraphs A1-A29 wherein the spacer is operatively attached to one or more of the plurality of projectiles.

A31. The shot shell payload of any of paragraphs A1-A30, further comprising an adhesive adhering the spacer to the first projectile and the second projectile.

A32. The shot shell payload of any of paragraphs A1-A31, wherein the spacer is a double-sided spacer.

A33. The shot shell payload of any of paragraphs A1-A31, wherein the spacer is a single-sided spacer.

A34. The shot shell payload of any of paragraphs A1-A33, wherein the threshold separation distance is at least 0.5 mm, at least 0.75 mm, at least 1 mm, at least 1.25 mm, at least 1.5 mm, at least 1.75 mm, at least 2 mm, at least 2.25 mm, and/or at least 2.5 mm.

A35. The shot shell payload of any of paragraphs A1-A34, wherein the spacer comprises a plurality of spacers.

A36. The shot shell payload of paragraph A34, wherein the plurality of spacers comprises a first spacer, a second spacer, a third spacer, a fourth spacer, a fifth spacer, and/or a sixth spacer.

A37. The shot shell payload of any of paragraphs A35-A36, wherein at least one of the plurality of spacers is positioned between two respective projectiles of the plurality of projectiles.

A38. The shot shell payload of any of paragraphs A35-A37, wherein at least one of the plurality of spacers comprises a first concave surface configured to receive at least a portion of one of the plurality of projectiles.

A39. The shot shell payload of any of paragraphs A35-A38, wherein at least one of the plurality of spacers comprises a second concave surface configured to receive at least a portion of one of the plurality of projectiles.

A40. The shot shell payload of any of paragraphs A35-A38, wherein at least one of the plurality of spacers comprises a first flat surface.

A41. The shot shell payload of paragraph A40, wherein the first flat surface is configured to contact one of the plurality of projectiles.

A42. The shot shell payload of any of paragraphs A35-A41, wherein at least one of the plurality of spacers comprises a second flat surface.

A43. The shot shell payload of paragraph A42, wherein the second flat surface is configured to contact one of the plurality of projectiles.

A44. The shot shell payload of any of paragraphs A35-A43, wherein at least one of the plurality of spacers comprises a first material and a second material, the second material being different from the first material.

A45. The shot shell payload of paragraph A44, wherein the first material of the at least one of the plurality of spacers contacts one of the plurality of projectiles and the second material of the at least one of the plurality of spacers contacts another of the plurality of projectiles.

A46. The shot shell payload of any of paragraphs A44-A45, wherein at least one of the plurality of spacers comprises a first flat surface and a second flat surface, and wherein the first flat surface comprises the first material and the second flat surface comprises the second material.

A47. The shot shell payload of any of paragraphs A35-A46, wherein at least one of the plurality of spacers comprises a cylindrical body that defines an internal volume.

A48. The shot shell payload of any of paragraphs A35-A47, wherein at least one of the plurality of spacers further comprises a contact region that conforms to one or more of the plurality of projectiles.

A49. The shot shell payload of any of paragraphs A35-A48, wherein at least one of the plurality of spacers comprises a partition separating a first internal volume from a second internal volume.

A50. The shot shell payload of any of paragraphs A35-A49, wherein at least one of the plurality of spacers comprises a resilient, elastomeric, and/or compliant material.

A51. The shot shell payload of any of paragraphs A35-A50, wherein at least one of the plurality of spacers comprises a polyethylene, a low density polyethylene, a high density polyethylene, a polystyrene, a polypropylene, a silicone, a polyvinyl chloride, a polyamide, a natural and/or synthetic rubber, a polytetrafluoroethlene, a polyester, an organic polymer, and/or an inorganic polymer.

A52. The shot shell payload of any of paragraphs A35-A51, wherein at least one of the plurality of spacers comprises a monolithic spacer.

A53. The shot shell payload of any of paragraphs A35-A52, wherein at least one of the plurality of spacers comprises a hollow, porous, and/or void-filled structure defining one or more internal volumes.

A54. The shot shell payload of paragraph A47, wherein the internal volume comprises a fluid, a gas, a particulate material, a polymeric material, a resilient material, and/or combinations of the above.

A55. The shot shell payload of paragraph A49, wherein the first internal volume and/or the second internal volume comprises a fluid, a gas, a particulate material, a polymeric material, a resilient material, and/or combinations of the above.

A56. The shot shell payload of paragraph A53, wherein the one or more internal volumes comprise a fluid, a gas, a particulate material, a polymeric material, a resilient material, and/or combinations of the above.

A57. The shot shell payload of any of paragraphs A35-A56, wherein at least one of the plurality of spacers comprises a spacer material, the plurality of projectiles comprise a projectile material, and the spacer material is different from the projectile material.

A58. The shot shell payload of any of paragraphs A35-A57, wherein at least one of the plurality of spacers is configured to tighten, narrow, and/or otherwise improve a pattern density of the plurality of projectiles as they are fired.

A59. The shot shell payload of any of paragraphs A35-A58, wherein at least one of the plurality of spacers is operatively attached to one or more of the plurality of projectiles.

A60. The shot shell payload of any of paragraphs A35-A59, wherein at least one of the plurality of spacers further comprises an adhesive adhering the at least one of the plurality of spacers, respectively, to one or two respective projectiles of the plurality of projectiles.

A61. The shot shell payload of any of paragraphs A35-A60, wherein at least one of the plurality of spacers is a double-sided spacer.

A62. The shot shell payload of any of paragraphs A35-A61, wherein at least one of the plurality of spacers is a single-sided spacer.

A63. The shot shell payload of any of paragraphs A1-A62, further comprising an end spacer, wherein the end spacer is positioned adjacent an end of the shot shell payload and contacts one of the plurality of projectiles.

B1. A wad for a shot shell, comprising:

a payload region configured to receive a shot shell payload according to any of paragraphs A1-A63, the payload region defining an internal wad diameter;

a payload-facing surface formed within the payload region; and a shot shell payload according to any of paragraphs A1-A63, wherein the shot shell payload is positioned within the payload region, adjacent the payload-facing surface.

B2. The wad according to paragraph B1, wherein the payload-facing surface comprises a concave cup configured to contact the shot shell payload.

B3. The wad according to any of paragraphs B1-B2, further comprising a gas seal region configured to prevent passage of gasses outside of the wad.

B4. The wad according to any of paragraphs B1-B3, further comprising a deform table region configured to deform and/or crumple when the wad is fired.

B5. The wad according to any of paragraphs B1-B4, further comprising one or more sidewalls extending from the payload-facing surface and surrounding the payload region.

B6. The wad according to paragraph B5, wherein the one or more sidewalls are configured to contain the shot shell payload.

B7. The wad according to any of paragraphs B5-B6, wherein the one or more sidewalls are joined proximate the payload-facing region.

B8. The wad according to any of paragraphs B5-B7, wherein the one or more sidewalls are configured to flare away when the wad exits a shotgun barrel.

B9. The wad according to any of paragraphs B1-B8, wherein at least one of the plurality of projectiles has a transverse cross-sectional area that is at least 70%, at least 75%, at least 80%, at least 85%, at least 90%, at least 95%, at least 98%, and/or at least 100% of the internal wad diameter.

B10. The wad according to any of paragraphs B1-B9, wherein the shot shell payload is the shot shell payload according to paragraph A63, and wherein the end spacer is positioned adjacent the payload-facing surface.

C1. A shot shell, comprising:

a casing defining an internal chamber; and a wad according to any of paragraphs B1-B10, wherein the wad is positioned within the internal chamber of the casing.

C2. The shot shell according to paragraph C1, wherein the shot shell payload is aligned along a longitudinal axis of the shot shell.

C3. The shot shell of any of paragraphs C1-C2, wherein the casing comprises a mouth portion and a head portion, the mouth portion and head portion being positioned on opposing ends of the casing.

C4. The shot shell of any of paragraphs C1-C3, further comprising a propellant.

C5. The shot shell of any of paragraphs C1-C4, further comprising a closure configured to seal the mouth portion.

C6. The shot shell of any of paragraphs C1-05, further comprising an ignition device.

C7. The shot shell of paragraph C6, wherein the ignition device comprises a primer, and/or a priming mixture.

C8. The shot shell of any of paragraphs C3-C7, wherein the payload-facing surface of the wad is positioned facing the mouth portion.

C9. The shot shell of any of paragraphs C5-C8, wherein the spacer comprises a plurality of spacers, and one of the plurality of spacers is positioned adjacent the closure.

D1. A shot gun, comprising:

a barrel; and a shot shell according to any of paragraphs C1-C9, the shot shell being positioned inside the barrel.

D2. The shot gun according to paragraph D1, wherein a projectile diameter of each of the plurality of projectiles is at least 50%, at least 55%, at least 60%, at least 65%, at least 70%, at least 75%, at least 80%, and/or at least 85% of a barrel diameter of the barrel.

Industrial Applicability

The systems and methods disclosed herein are applicable to the firearms and ammunition fields.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, when the disclosure or subsequently filed claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A shot shell, comprising:

a casing defining an internal chamber having a longitudinal axis, wherein the casing comprises a mouth portion and a head portion, the mouth portion and the head portion being positioned on opposing ends of the casing;

a primer and a propellant within the casing; and a wad positioned within the internal chamber of the casing;

a payload positioned within the internal chamber of the casing, wherein the wad separates the payload from the primer and the propellant, and further wherein the payload comprises:

a plurality of projectiles, the plurality of projectiles comprising at least a first projectile and a second projectile aligned with the first projectile along the longitudinal axis; wherein the plurality of projectiles are formed from a projectile material; wherein each of the plurality of projectiles is a solid, non-frangible projectile that is at least substantially formed of metal and has a cross-sectional area measured transverse to the longitudinal axis that is at least 70% of the cross-sectional area of the casing measured transverse to the longitudinal axis; and a first spacer aligned with the first projectile and the second projectile along the longitudinal axis, wherein the first spacer is positioned between the first projectile and the second projectile and configured to separate the first projectile from the second projectile by a first threshold separation distance; wherein the first spacer is formed from a non-metallic spacer material wherein the first spacer comprises a first concave surface configured to receive at least a portion of the first projectile; and further wherein the first spacer comprises a second concave surface configured to receive at least a portion of the second projectile;

wherein the wad further comprises sidewalls that extend generally away from the head portion and propellant and define a payload region into which the plurality of projectiles and the first spacer are housed within the internal chamber, and further wherein the first spacer engages the sidewalls of the wad, and further wherein the first spacer does not engage the casing.

2. The shot shell of claim 1, wherein the threshold separation distance is at least 0.5 mm and less than 2.5 mm.

3. The shot shell of claim 1, wherein the spacer material is at least one of a resilient material, an elastomeric material, and/a compliant material.

4. The shot shell of claim 1, wherein the spacer material includes at least one of a polyethylene, a low density polyethylene, a high density polyethylene, a polystyrene, a polypropylene, a silicone, a polyvinyl chloride, a polyamide, a natural rubber, a synthetic rubber, a cork, a polytetrafluoroethlene, a polyester, an organic polymer, and an inorganic polymer.

5. The shot shell of claim 1, wherein the spacer material consists essentially of at least one of a polyethylene, a low density polyethylene, a high density polyethylene, a polystyrene, a polypropylene, a silicone, a polyvinyl chloride, a polyamide, a natural rubber, a synthetic rubber, a cork, a polytetrafluoroethlene, a polyester, an organic polymer, and an inorganic polymer.

6. The shot shell of claim 1, wherein the first spacer comprises a hollow structure defining one or more internal volumes.

7. The shot shell of claim 6, wherein the one or more internal volumes comprise at least one of a fluid, a gas, a particulate material, a polymeric material, and a resilient material.

8. The shot shell of claim 1, wherein at least one of the plurality of projectiles is a spherical, hemispherical, conical, pointed, blunt, ogived, mushroom-shaped, or symmetrical projectile.

9. The shot shell of claim 1, wherein each of the plurality of projectiles is spherical.

10. The shot shell of claim 9, wherein the first concave surface and the second concave surface of the first spacer respectively each receive at least 30% of the surface area of corresponding first and second projectiles.

11. The shot shell of claim 1, wherein the first spacer is adhered to at least one of the plurality of projectiles.

12. The shot shell of claim 1, wherein the shot shell further comprises a third projectile aligned along the longitudinal axis of the shot shell payload and a second spacer aligned along the longitudinal axis, wherein the second spacer is positioned between the second projectile and the third projectile and configured to separate the second projectile from the third projectile by a second threshold separation distance.

13. The shot shell of claim 12, wherein the first spacer and the second spacer have the same shape.

14. The shot shell of claim 12, wherein the first projectile, the second projectile, and the third projectile have the same size, shape, and density.

15. The shot shell of claim 12, wherein the first projectile, the second projectile, and the third projectile are spherical.

16. The shot shell of claim 12, wherein the first spacer is adhered to at least one of the first projectile and the second projectile, and further wherein the second spacer is adhered to at least one of the second projectile and the third projectile.

17. The shot shell of claim 12, wherein the threshold separation distance between the first projectile and the second projectile is at least 0.5 mm, and further wherein the second threshold separation distance between the second projectile and the third projectile is at least 0.5 mm.

18. The shot shell of claim 1, wherein the wad further comprises a gas seal region configured to restrict passage of gasses between the wad and the casing when the shot shell is fired, and wherein the wad further comprises a deformable region configured to deform when the shot shell is fired.

19. The shot shell of claim 1, wherein each of the plurality of projectiles comprises at least 95 wt % steel.

20. The shot shell of claim 19, wherein the first spacer is formed from polyethylene.

21. The shot shell of claim 1, wherein the first spacer is formed from polyethylene.

22. The shot shell of claim 1, wherein the first projectile and the second projectile have the same size, shape, and density.

* * * * *

UNITED STATES PATENT AND TRADEMARK OFFICE

CERTIFICATE OF CORRECTION

PATENT NO. : 9,207,050 B2
APPLICATION NO. : 14/313700
DATED : December 8, 2015
INVENTOR(S) : Michael Clifford Sorensen It is certified that error appears in the above-identified patent and that said Letters Patent is hereby corrected as shown below:

In the Claims:

Column 18, line 10, please delete "and/a" and insert --and a-- therefor.

Signed and Sealed this
Eighth Day of March, 2016

Michelle K. Lee

Michelle K. Lee
*Director of the United States Patent and Trademark Office*